US005586460A

United States Patent [19]

Steingroever

[11] Patent Number: 5,586,460

[45] Date of Patent: Dec. 24, 1996

[54] DEVICE WITH PEAK CURRENT LOOP AND PROCESS FOR THE MAGNETIC SHAPING OF METAL PARTS

[75] Inventor: Erich Steingroever, Bonn, Germany

[73] Assignee: Magnet-Physik Dr. Steingroever GmbH, Germany

[21] Appl. No.: 417,897

[22] Filed: Apr. 6, 1995

[30] Foreign Application Priority Data

Oct. 13, 1994 [DE] Germany ..... 44 36 615.9

[51] Int. Cl.[6] ..... B21D 26/02

[52] U.S. Cl. ..... 72/56; 72/54; 29/419.2

[58] Field of Search ..... 72/54, 56, 706; 29/419.2

[56] References Cited

U.S. PATENT DOCUMENTS

| | | | |
|---|---|---|---|
| 3,252,313 | 5/1966 | Eilers et al. | 72/56 |
| 3,391,558 | 7/1968 | Deeg | 72/56 |
| 3,610,007 | 10/1971 | Wildi | 72/56 |
| 4,169,364 | 10/1979 | Khimenko et al. | 72/56 |

FOREIGN PATENT DOCUMENTS

| | | | |
|---|---|---|---|
| 1257728 | 1/1968 | Germany | 72/56 |

*Primary Examiner*—David Jones
*Attorney, Agent, or Firm*—Harold Gell

[57] ABSTRACT

A high-current loop connected to a pulse transformer is made as a magnetic field shaper with an opening to receive a metal part which is to be shaped. The high-current loop has a slit extending radially with respect to this opening in the direction toward conductor blocks connecting it to the secondary winding of the pulse transformer. The high-current loop can also be made as an exchangeable magnetic field shaper, made up of one block that is divided in the area of the opening, preferably consisting of copper or aluminum, that has an opening for the metal part which is to be shaped. This design of a high-current loop is used to receive pipe-shaped metal parts that are to be shaped, that, outside of the deformation, have a larger outside diameter, that receive a metal part with a larger volume, and/or that are pre-bent in a serpentine fashion.

17 Claims, 5 Drawing Sheets

27
25a
25
18
30
7
23a
24a
26
24
23
1
19b
22
22
16
17
15
17a
20
19a
9
10
21
17a
2
8

2
25
25a
23
18
23a
30
7
27
24
26
24a
15
20
17a
28
19a
9
8
19b
10
29
21
17a
16
17

DEVICE WITH PEAK CURRENT LOOP AND PROCESS FOR THE MAGNETIC SHAPING OF METAL PARTS

FIELD OF THE INVENTION

This invention relates to high-current loop pulse transformers for magnetic shaping of metal parts by high-energy magnetic pulses and to a process for the magnetic shaping of metal parts by means of such devices.

BACKGROUND OF THE INVENTION

In particular, the invention relates to a pulse transformer with a high-current loop extension of a secondary coil according to German Patent Application P 44 23 992.0. Optionally, the high-current loop extension is exchangeable. This patent application proposes to allow a high-current conductor to act upon a magnetic field concentrator with an opening for the metal to be shaped, which part it envelops. The magnetic field concentrator is a copper or aluminum cylinder that is slit singly or doubly in a radial manner and that receives the narrowest point of the metal part to be shaped in the opening.

Such magnetic field concentrators are awkward to handle and work with considerable transmission losses because a large part of the pulse energy is lost due to the transfer of said energy first of all to the magnetic field concentrator and then, from the latter, to the metal part to be shaped.

OBJECTIVES OF THE INVENTION

The purpose of the invention is to prevent transfer losses and to create a device consisting of few components, including a high-current loop and a pulse transformer for the magnetic shaping of metal parts with improved efficiency with high-energy magnetic pulses.

According to the invention, the transfer loss problem is solved by the high-current loop being a magnetic field shaper with an opening to receive the metal part to be shaped and a slit that extends radially with respect to this opening. Preferably, the slit runs in the direction toward the poles of the pulse transformer.

This results in a device of particularly simple structure with considerably smaller transfer losses when compared to the older arrangement, i.e. the high-current loop of the device is series-connected with the secondary coil of the pulse transformer and defines the area of the shaping magnetic field by being made as the field shaper or magnetic field concentrator, whereby the high-current loop incorporates an opening to receive a part to be shaped and is slit radially with respect to this opening.

SUMMARY OF THE INVENTION

In a preferred version of the invention, the high-current loop is divided in the area of the shaping magnetic field and is made so that it can be opened. As a result, the device can be used to shape metal parts that, outside the shaping point, have greater dimensions than the shaping point and that cannot be inserted into the known magnetic field concentrators or can be inserted only in a laborious manner. Such parts are metal pipes with fittings that are greater than the pipe diameter, that have T-shaped connecting pieces, or that may already be bent to form long serpentine pipes.

In the preceding application it is particularly advantageous to divide the high-current loop laterally with respect to the opening that receives the metal part which is to be shaped.

In a particularly advantageous additional feature of the invention, the high-current loop can also be made as an exchangeable magnetic field shaper consisting of one block, preferably of copper or aluminum or a corresponding, high strength, electrically good conducting alloy, that has an opening for the metal part to be shaped, or that is divided in the area of the opening.

To receive the metal parts to be shaped, the division of the high-current loop is opened, the metal part is inserted, and the conductor is closed so that its top part is pressed upon the bottom part so that a high-current pulse can flow.

The forgoing embodiment is particularly advantageous if the high-current loop is used to receive pipe-shaped metal parts to be shaped and that, outside the deformation area, have a larger outside diameter, a larger volume and/or may be pre-bent in a serpentine fashion.

One can achieve particularly high production precision by pressing the parts of the high-current loop that form the opening against the high-pressure occurring during shaping, using mechanical means for this purpose, so that they themselves cannot be deformed.

To achieve trouble-free and safe handling, the current conducting parts of the high-current loop are pressed together with intermediate layers consisting of a raw material—especially silver—that will prevent the parts from becoming welded together.

One aspect that is particularly advantageous for making such high-current loops, and for current conduction likewise, is to have the high-current loop have a block shaped top part with half an opening that is pressed upon lower conductor blocks with the other half opening. In this way, one can achieve particularly high-fit accuracy if the top part also grasps the bottom conductor blocks laterally. Advantageously, the top part and the lower conductor blocks rest upon each other with flanks that are inclined toward each other in roof fashion.

DESCRIPTION OF THE DRAWINGS

Preferred practical examples of the invention are illustrated schematically in the drawing wherein.

DETAILED DESCRIPTION OF THE INVENTION

Figure 8:
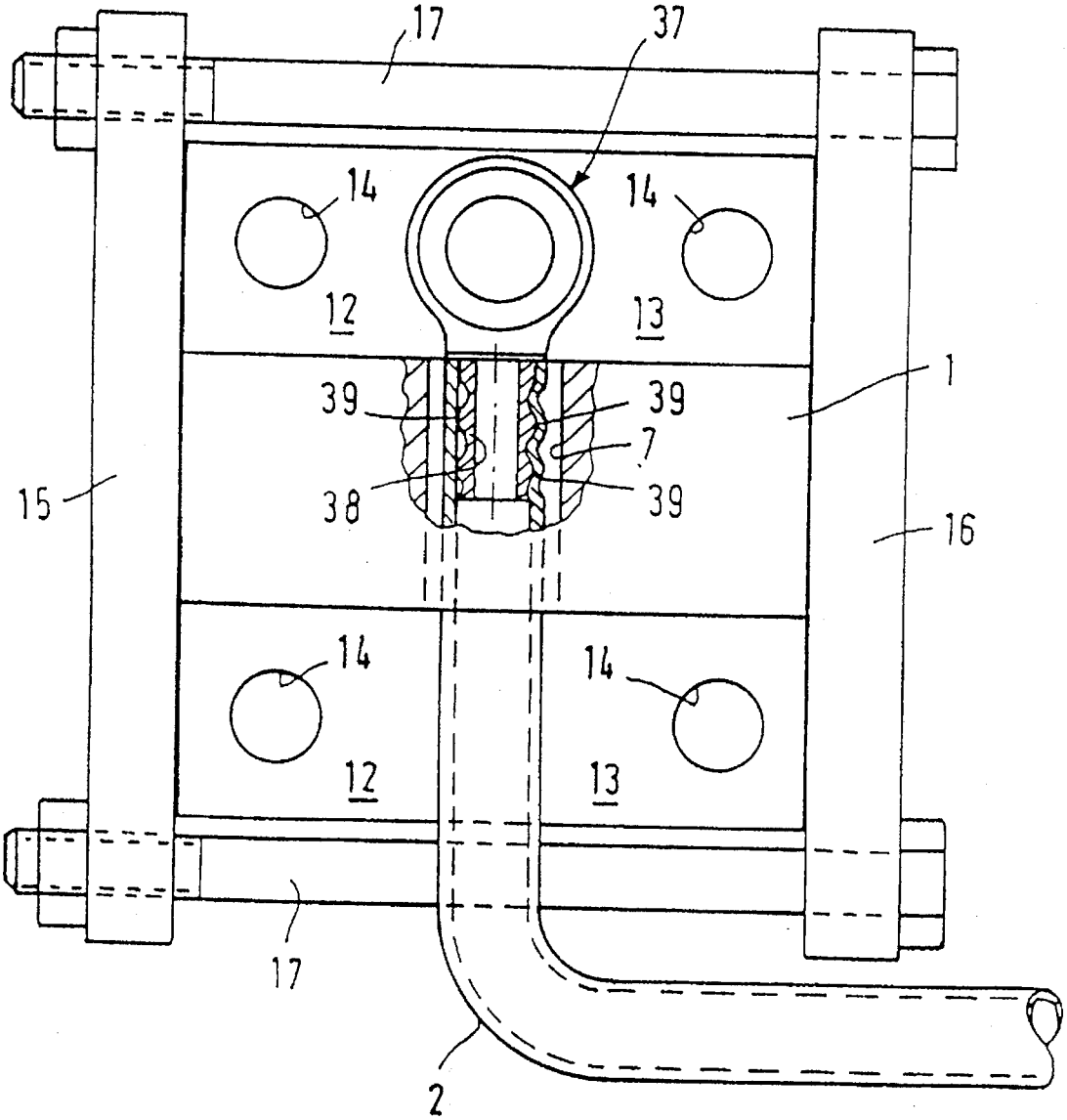
FIG. 8 is a top view of a divided high-current loop according to FIGS. 3 to 6, with a metal pipe, inserted into the opening of the high-current loop, shown in a cutaway view, said metal pipe being bent and intended for shaping, with a terminal connecting part, for example, a fitting.

The embodiments of high-current loops 1, illustrated in FIGS. 2 through 6, for the magnetic shaping of metal parts 2, as illustrated in FIG. 8, with high-energy magnetic pulses, are intended for connection to a pulse transformer 3 such as described, for example, in German Patent Application P 44 23 992.0, dated 7 Jul. 1994. The pulse transformer 3 consists of a high-current conductor 3*a* in the form of a longitudinally slit copper pipe with a primary coil 3*b* and an iron core 3*c*. The copper pipe that serves as the high-current conductor secondary winding 3*a* is insulated from the iron core 3*c* by a closed protective pipe 3*d* made of plastic. Pulse transformer 3 is connected to its primary circuit 4 which is a condenser 5 excited by closing a switch 6 (preferably, an electronic switch, such as a thyristor or ignitron).

In all practical examples shown, the high-current loop 1 is made as a magnetic field former with an opening 7 to receive a metal part 2 which is to be shaped, and it has a slit 8 that runs radially with respect to this opening, in the direction toward conductor blocks 9, 10 of pulse transformer 3.

Figure 2:
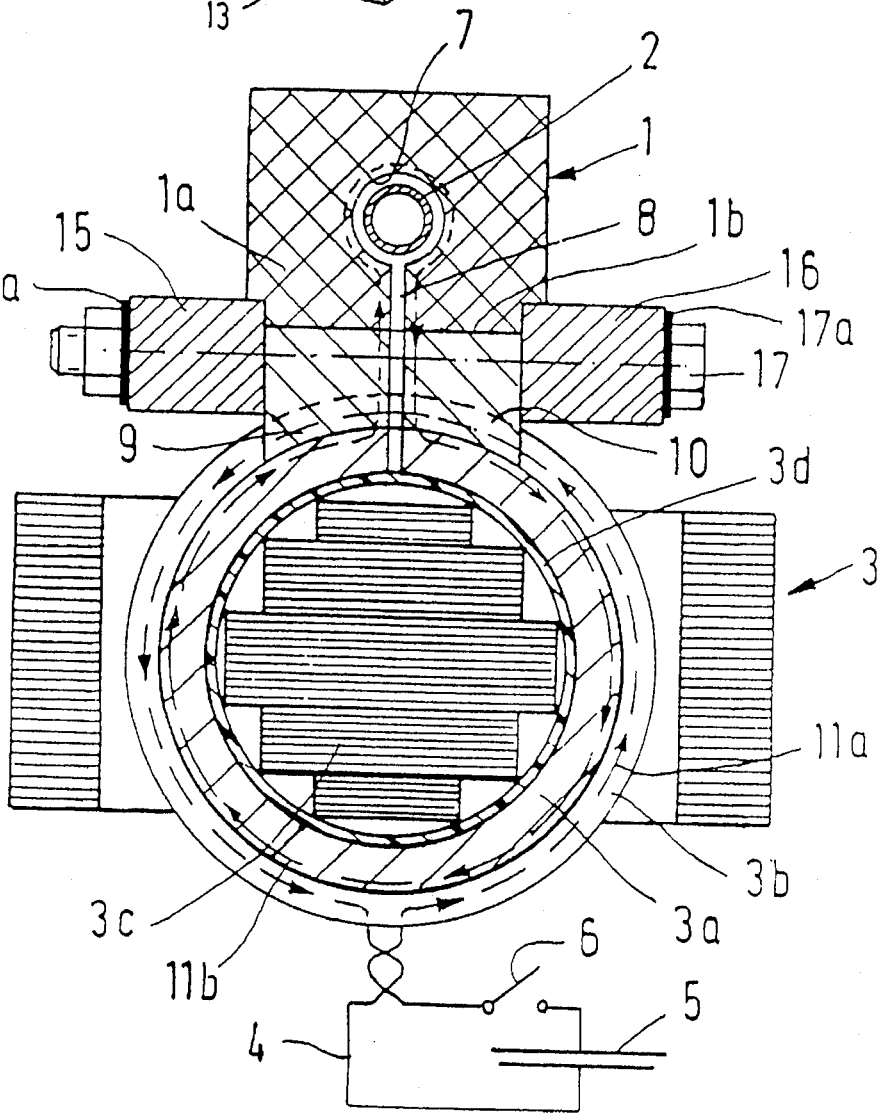
FIG. 2 is a perpendicular profile through an embodiment of a high-current loop and pulse transformer.
Figure 3:
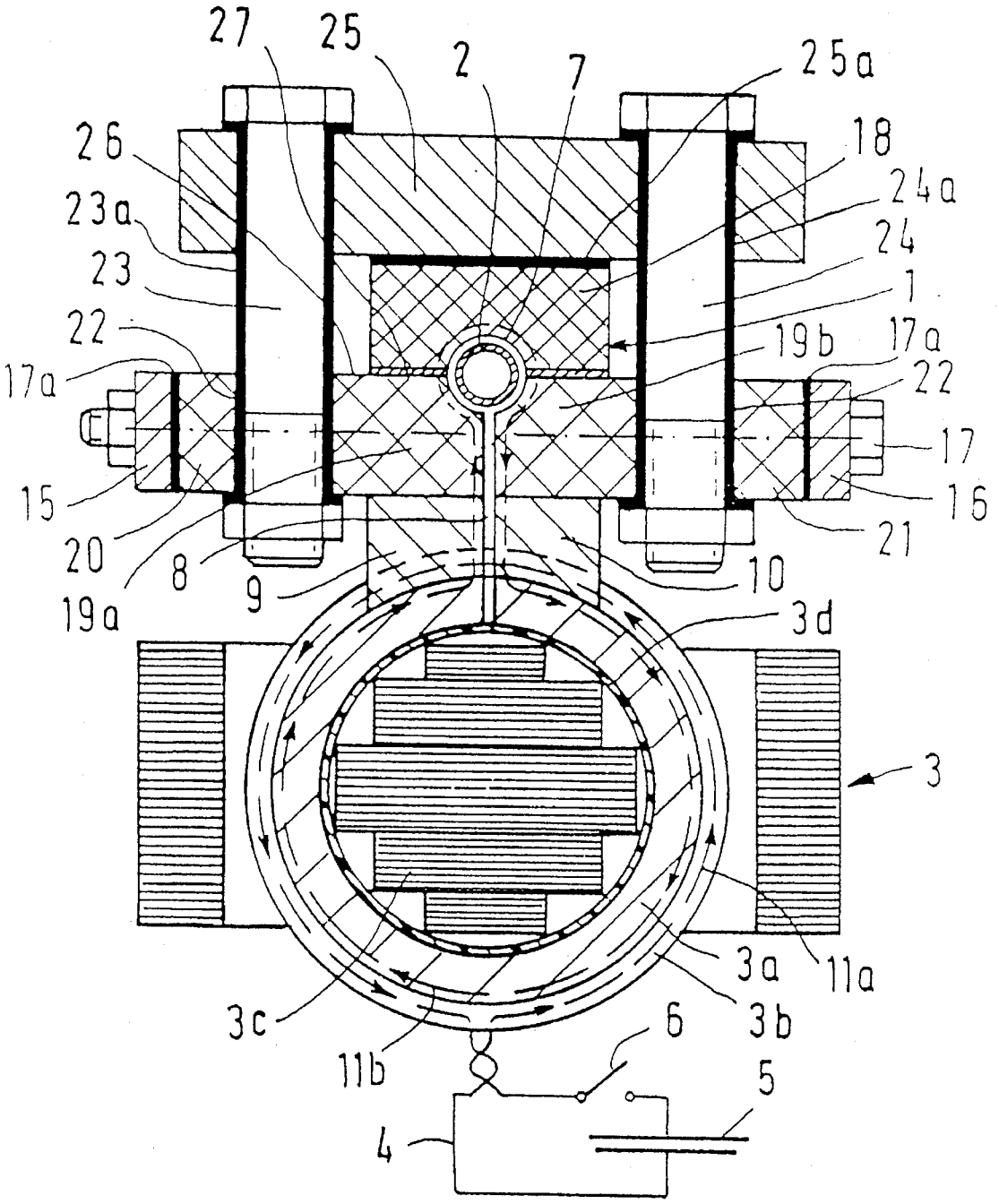
FIG. 3 is a perpendicular profile through an embodiment with a divided block shaped high-current loop and pertinent pulse transformer.

The current passage from primary circuit 4 through pulse transformer 3 and onward, through the high-current loop 1, which is directly connected to conductor blocks 9, 10 of said pulse transformer, is indicated in FIG. 2 by arrows 11*a* for the flow of current in the primary circuit and 11*b* for the flow of current in the secondary circuit.

Figure 1:
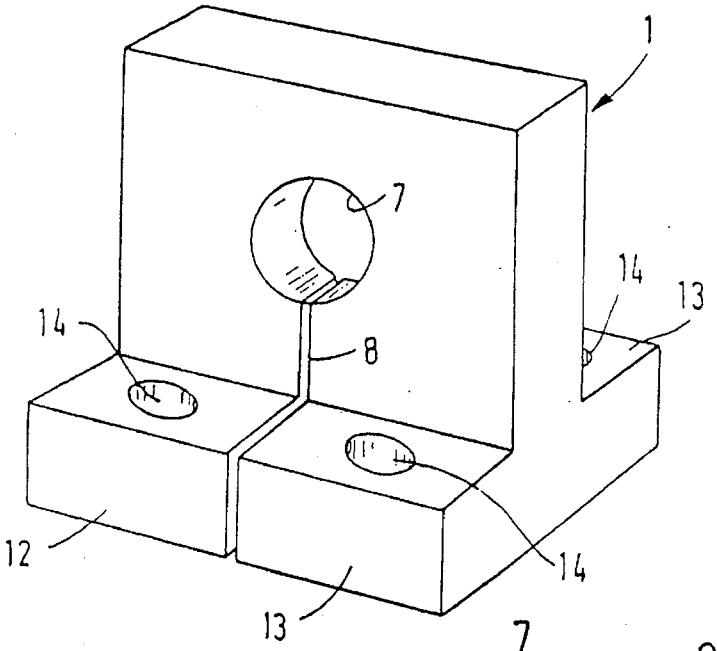
FIG. 1 is a perspective view of a block shaped high-current loop.

In the practical example shown in FIG. 1, the high-current loop 1 consists of a conductor block made up of an electrically good conducting material, such as copper, aluminum, or a high-strength, electrically good conducting alloy, such as CuCrZr, which, in its middle, has an opening 7 to receive a metal part to be shaped, with slit 8 that extends radially therefrom in the direction toward conductor blocks 9, 10 of pulse transformer 3, whereby, on both sides of slit 8, there are arranged assembly and conductor flanges 12, 13 with bore holes 14 for attachment and for contact with conductor blocks 9, 10 of pulse transformer 3 in a common plane and parallel with respect to each other.

In the changed practical example shown in FIG. 2, the two parallel legs 1*a*, 1*b* of high-current loop 1, as shown in FIG. 1, are additionally held together, under opening 7, by means of two side rails 15, 16, that engage both parallel outer sides of legs 1*a*, 1*b* of high-current loop 1 and that are held together by clamping bolt assemblies 17 with insulations 17*a*. Side rails 15, 16, as shown in FIG. 8, are longer than the outer length of the oppositely protruding assembly flanges 12, 13 of the high-current loop 1 so that the two clamping bolt assemblies 17 extend outside the assembly and conductor flanges 12, 13 of the high-current loop 1 on the front face of the latter and whose reverse side runs laterally with respect to slit 8.

In the other different practical examples shown in FIGS. 3 to 8, the high-current loop 1 is divided—in the area of the shaping magnetic field—laterally with respect to the opening 7 that receives the metal parts 2 which are to be shaped.

As one can see in the practical examples shown in FIGS. 3 to 6 illustrating this kind of shaping device, the high-current loop 1 consists of a block shaped upper part 18, incorporating half of the opening 7, which is pressed upon lower conductor blocks 19*a* and 19*b* which form the other half of opening 7 with slit 8 running in the direction toward conductor blocks 9 and 10 of pulse transformer 3.

The lower conductor blocks 19*a* and 19*b* have unilaterally fashioned side flanges 20, 21 that protrude laterally beyond the block shaped upper part 18 and that have mutually parallel, perpendicular bore holes 22 for the fastening bolts 23, 24, by means of which the block shaped upper part 18—using an upper clamping bar 5 and an intermediate layer of insulating material 25*a*—is pressed with powerful pressure against the lower conductor blocks 19*a* and 19*b*. The fastening bolts 23, 24 are electrically insulated by insulators 23*a*, 24*a*, both with respect to the lower conductor blocks 19*a* and 19*b*, and with respect to the upper clamping bar 25. Moreover, in this particular practical example, the laterally extending separating plane 26, between the lower conductor blocks 19*a* and 19*b* and the block shaped upper part 18 of the high-current loop 1, is made flat adjacent to the middle of opening 7.

Here it is particularly advantageous when the current conducting parts of the high-current loop 1 are pressed together to use intermediate layers 27, made up of a material—especially silver—that prevents the parts from becoming welded together.

In a particularly advantageous manner, such a high-current loop 1 can be used to receive the tube shaped metal parts 2 which are to be shaped and which—outside the shaping area—either have a greater outside diameter or receive a metal part with a larger volume and/or can also be pre-bent in a serpentine fashion, as shown in the top view in FIG. 8.

Figure 5:
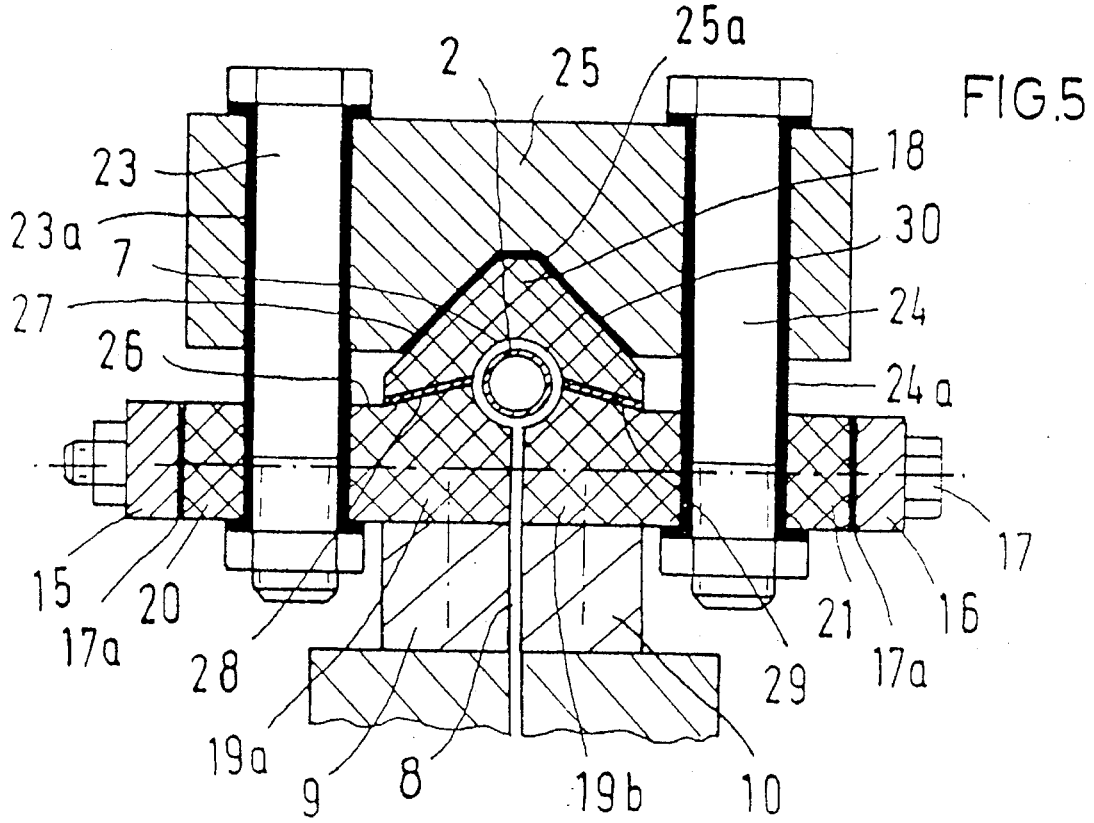
FIG. 5 is a perpendicular profile through an alternate version of the divided block shaped high-current loop.

In such a divided high-current loop 1, the former can also be made up of a block shaped upper part 18 and lower conductor blocks 19*a* and 19*b* in such a manner that the upper part 18 will also laterally grasp the lower conductor blocks 19*a* and 19*b*, as shown in FIG. 5, whereby one can achieve a particularly good cohesion of upper part and lower conductor blocks in that upper part 18 and lower conductor blocks 19*a* and 19*b* rest upon each other with flanks 28, 29 that are inclined toward each other.

Figure 4:
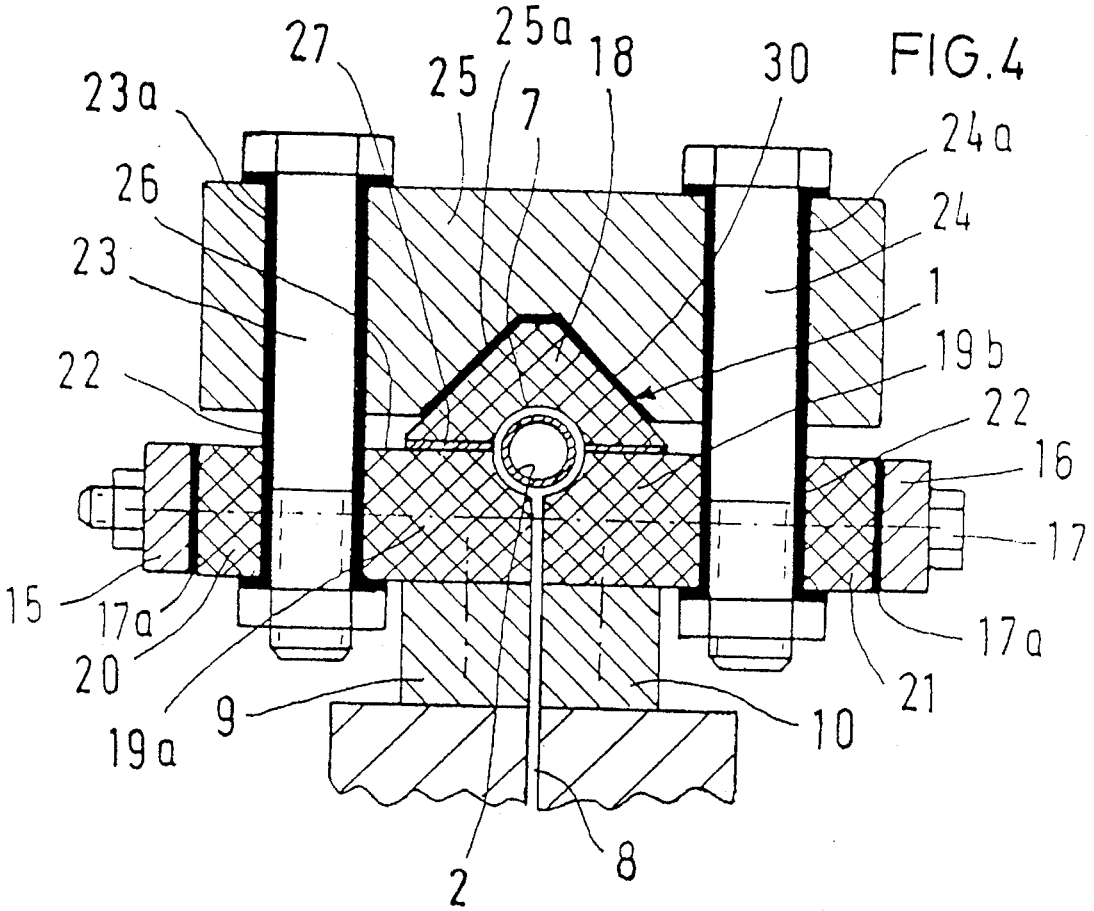
FIG. 4 is a perpendicular profile through an alternate embodiment of the divided block shaped high-current loop illustrated in FIG. 3.

The parts of opening 7 that envelop the divided block shaped high-current loop 1—in all practical examples shown, from FIG. 3 to FIG. 8—are firmly pressed together, with mechanical means, against the high-pressure that occurs during shaping, for example, by means of side rails 15, 16 that rest, parallel to slit 8, against the two outer sides of conductor blocks 19*a* and 19*b*, and that are held together by nut and bolt assemblies 17, as one can see in the profile view in FIG. 2 and in the top view in FIG. 8. The press-on pressure and thus the cohesion of the parts can here be further increased in that upper part 18 of high-current loop 1 is made with a trapezoidal cross-section creating a frustum shape, upward, and engages a correspondingly shaped reception recess 30 on the upper clamping bar 25 in a form-locking manner with an insulating intermediate layer 25*a*, as shown in FIGS. 4 and 5.

Figure 6:
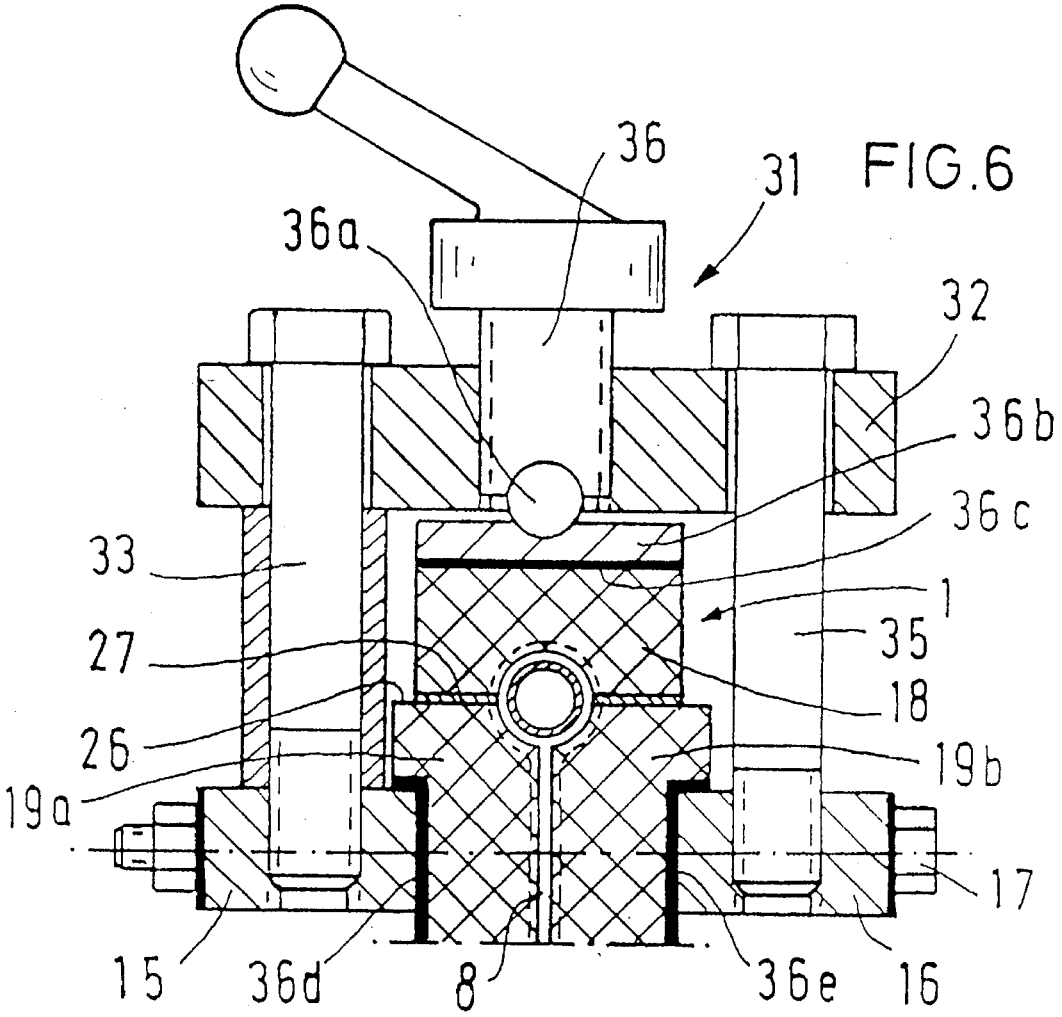
FIG. 6 is a perpendicular profile through a divided block shaped high-current loop with a mechanical quick-grip device.
Figure 7:
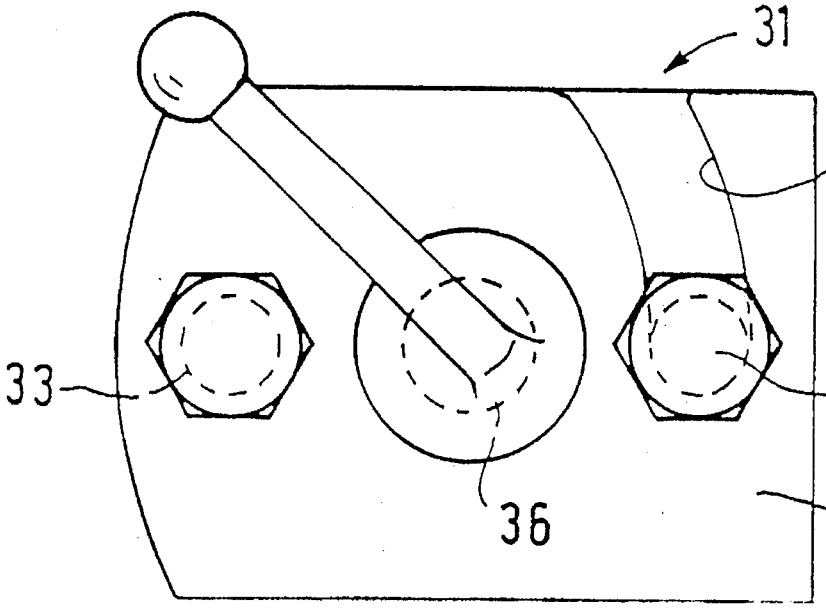
FIG. 7 is a top view of the quick-grip device in FIG. 6.

FIGS. 6 and 7 show a mechanical quick-grip device 31. The latter consists of two parallel side rails 15, 16 that engage on the lower conductor blocks 19*a* and 19*b* and that are held together by clamping bolts 17 with insulators 17a, plus a swingable upper clamping block 32 that can be rotated around a perpendicular clamping bolt 33 and that has a receiving slit 34 that is open toward one side and that is intended for the other fastening bolt 35 that protrudes parallel thereto, in such a manner that the clamping block 32, with a clamping spindle 36 arranged in the middle thereof can be swung away to the side from the upper part 18 of high-current loop 1 in order to lift upper part 18 off the lower conductor blocks 19*a* and 19*b* and to insert a metal part to be shaped into the lower half of opening 7 on the two lower conductor blocks 19*a* and 19*b*. Subsequently, upper part 18 of high-current loop 1, with intermediate layers 27—consisting of a material such as silver, that prevents the welding-together of high-current conducting parts—is placed upon the lower conductor blocks 19*a* and 19*b*, and the clamping block 32 is again swung over upper part 18 in order to firmly press upper part 18 against the lower conductor blocks 19*a* and 19*b* by means of manually operated clamping spindle 36. A ball 36*a* at the end of clamping spindle 36, together with a pressure plate 36*b*, with insulator 36*c*, absolutely provides center pressure upon upper part 18 of high-current loop 1. Between side rails 15 and 16 and lower conductor blocks 19*a* and 19*b* there are additional insulators 36*d* and 36*e* that electrically insulate the high-current loop 1 from the quick-grip device 31.

Instead of a manual mechanical clamping device 31, one can, of course, provide a hydraulically, pneumatically or electromechanically activated clamping device.

The top view in FIG. 8 illustrates the high-current loop 1 with a metal part 2 that is to be shaped and that has been inserted into opening 7. Metal part 2 is an aluminum pipe with a terminal fitting 37 with a pipe socket 38 that is provided with several external parallel cross-ribs 39. The aluminum pipe and the pipe socket 38 are illustrated in a cutaway fashion in the connection area, specifically, on the left side, in the unshaped state, and on the right side, after the shaping of the aluminum pipe by a high-energy magnetic pulse. In that way, the aluminum pipe is fashioned around the cross-ribs 39 in a closely adhering manner and is so pressed into the ring-shaped recesses between cross-ribs 39 that one can generate a lasting, absolutely solid and tightly sealed connection between the aluminum pipe and fitting 37. While preferred embodiments of this invention have been illustrated and described, variations and modifications may be apparent to those skilled in the art. Therefore, I do not wish to be limited thereto and ask that the scope and breadth of this invention be determined from the Claims which follow rather than the above description.

What is claimed is:

1. A pulse transformer with a high-current loop for magnetic shaping metal parts with high-energy magnetic pulses, characterized in that said high-current loop is a magnetic field shaper, comprising:

an opening to receive metal parts which are to be shaped;

a slit extending through the material of said high-current loop radially with respect to said opening;

said high-current loop characterized in that it is divided into segments forming said opening and separable along a plane through said opening; intermediate layers between said segments of said high-current loop that form said opening, said intermediate layers consisting of a material that prevent parts from becoming welded together; and means for pressing together said segments of said high-current loop that form said opening.

2. A device according to claim 1, characterized in that said high-current loop is divided laterally with respect to said opening.

3. A device according to claim 1, characterized in that said high-current loop is exchangeable and comprises a divided block of material selected from the group of materials including copper and aluminum wherein the plane defining the division of said block passes through said opening.

4. A device according to claim 1, characterized in that:

said high-current loop has a block-shaped upper part including a portion of said opening: and conductor blocks which form the lower part of said high-current loop and the remainder of said opening.

5. A device according to claim 4, characterized in that said upper part and said conductor blocks of said high-current loop rest upon each other with flanks that are inclined toward each other.

6. A pulse transformer with a high-current loop for magnetic shaping metal parts with high-energy magnetic pulses, characterized in that said high-current loop is a magnetic field shaper, comprising:

an opening to receive metal parts which are to be shaped;

a slit extending through the material of said high-current loop radially with respect to said opening;

conductor blocks coupling said pulse transformer to said high-current loop, characterized in that said slit lies in the direction toward said conductor blocks; said high-current loop characterized in that it is exchangeable and comprises a divided block of material wherein the plane defining the division of said block passes through said opening; and an intermediate layer separating the divided sections of said divided block of said high-current loop, said intermediate layer consisting of a material that prevent parts from becoming welded together.

7. A device according to claim 6, characterized in that said high-current loop is divided laterally with respect to said opening.

8. A device according to claim 7, characterized in that:

said high-current loop has a block-shaped upper part including a portion of said opening; and said conductor blocks form the lower part of said high-current loop and the remainder of said opening.

9. A device according to claim 8, characterized in that said upper part and said conductor blocks of said high-current loop reset upon each other with flanks that are inclined toward each other.

10. A device according to claim 6, characterized in that said high-current loop is exchangeable and comprises a divided block of material selected from the group of materials including copper and aluminum wherein the plane defining the division of said block passes through said opening.

11. A device according to claim 6, comprising:

a means for pressing together said divided block of said high-current loop.

12. A device according to claim 6, characterized in that:

said high-current loop has a block-shaped upper part including a portion of said opening; and said conductor blocks form the lower part of said high-current loop and the remainder of said opening.

13. A device according to claim 12, characterized in that said upper part is dimensioned to grasp said conductor blocks.

14. A device according to claim 13, characterized in that said upper part and said conductor blocks of said high-current loop rest upon each other with flanks that are inclined toward each other.

15. A device according to claim 12, characterized in that said upper part and said conductor blocks of said high-current loop rest upon each other with flanks that are inclined toward each other.

16. A process for the magnetic shaping of metal parts with high-energy magnetic pulses by means of a pulse transformer with a high-current loop magnetic shaper, including the steps of:

opening a magnetic shaper cavity formed by segments of said high-current loop separable along a plane passing through said cavity;

inserting a part to be shaped into said cavity;

closing said cavity while maintaining said segments separable by a means there between which prevents said segments from becoming welded together; and applying a high-energy pulse to said high-current loop magnetic shaper.

17. A process for magnetic shaping of metal part as defined by claim 16, including the step of clamping said segments together after said cavity is closed and before the application of said high-energy pulse.

* * * * *